United States Patent [19]

Kreager et al.

[11] 4,455,810

[45] Jun. 26, 1984

[54] METHOD AND APPARATUS FOR DETECTING POSSIBLY DEFECTIVELY-SEALED BAGS

[75] Inventors: William D. Kreager, Dallas, Tex.; Stanley I. Mason, Jr., Weston, Conn.; Larry W. Wilson, Dallas, Tex.

[73] Assignee: Frito-Lay, Inc., Dallas, Tex.

[21] Appl. No.: 318,054

[22] Filed: Nov. 4, 1981

[51] Int. Cl.[3] ..... B65B 57/06

[52] U.S. Cl. ..... 53/451; 53/493; 53/55; 53/65; 53/551

[58] Field of Search ..... 53/55, 451, 493, 141, 53/411, 383, 505, 506, 65, 77, 551, 552; 156/64, 379, 378, 352, 356, 361; 493/7, 12, 11, 6, 27

[56] References Cited

U.S. PATENT DOCUMENTS

| | | | |
|---|---|---|---|
| 2,949,714 | 8/1960 | Davis | 53/506 X |
| 3,326,097 | 6/1967 | Lokey | 53/552 X |
| 3,359,703 | 12/1967 | Quaadgras | 53/493 |
| 3,409,198 | 11/1968 | Peterman, Sr. | 156/64 X |
| 3,678,276 | 7/1972 | Lampi et al. | 156/64 X |
| 3,967,994 | 7/1976 | Langberg | 156/64 |
| 4,077,308 | 3/1978 | Scully | 53/552 X |
| 4,189,335 | 2/1980 | Evans et al. | 156/64 |

*Primary Examiner*—Horace M. Culver

*Attorney, Agent, or Firm*—Bernard, Rothwell & Brown

[57] ABSTRACT

A method and apparatus are disclosed herein for detecting possibly defectively-sealed bags and for preventing said bags from being filled. A sensor is provided to develop a first signal upon detection of a defect in a line of adhesive on flexible bag-forming material moving past the sensor. The first signal is used to generate an output signal at a time corresponding to the time when the defect-containing portion of the bag-forming material has moved from the sensor into position to be filled with product. Preferably, said filling position is located a plurality of bag lengths downstream from said sensor.

13 Claims, 1 Drawing Figure

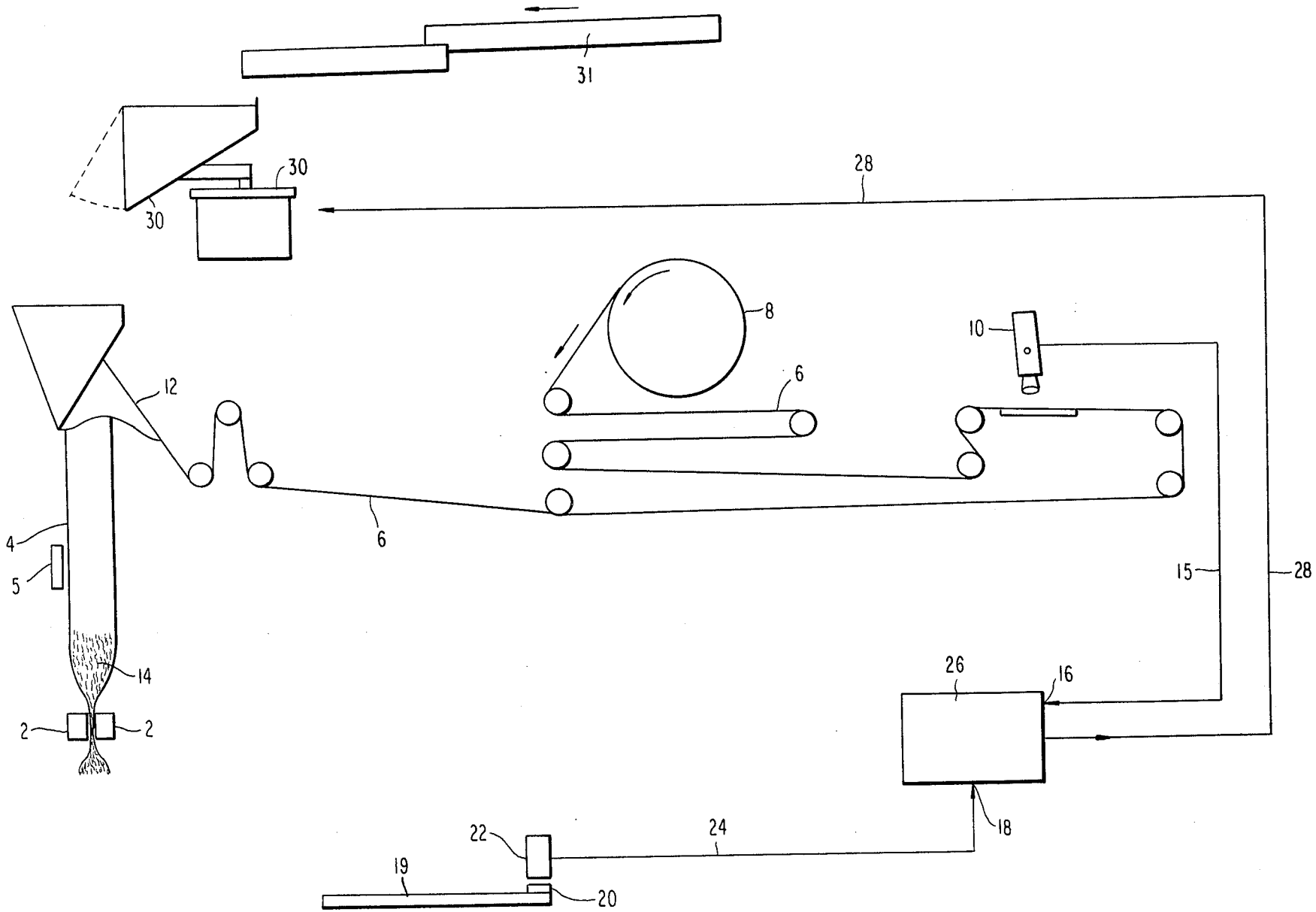
28
15
16
18
10
26
28
6
8
24
31
20
22
19
6
30
30
12
14
2
2
4
5

METHOD AND APPARATUS FOR DETECTING POSSIBLY DEFECTIVELY-SEALED BAGS

FIELD OF THE INVENTION

This invention relates to a method and an apparatus for detecting possibly defectively-sealed bags, and for preventing these bags from being filled with product.

DESCRIPTION OF THE PRIOR ART

Bags for potato chips or other products may be formed, filled and sealed in a substantially continuous operation by a system of known design. In such a system, the bags are formed from a sheet of bag-forming material on which a line of adhesive has been placed adjacent one edge.

To produce a bag, the bag-forming, sheet material is formed into a tube by bringing the edges of the material into engagement as the material passes over a bag-forming device. A portion of the tube corresponding to an end of a bag is gripped and sealed by jaws to form a closed-end tube. The jaws move downward pulling the closed-end tube past a device which seals the engaged edges by applying heat and pressure to the edges and the adhesive therebetween to form a back seal along the closed-end tube. The closed-end tube may be filled with product from a suitable device at substantially the same time that it is being back sealed or immediately thereafter. The jaws then release the sealed end and move upward along the length of the closed-end tube. The jaws stop and close together at a point corresponding to the opposite end of a product-filled bag to seal the end of the tube containing product to form the filled bag. The jaws simultaneously seal the end of the next tube and then move downward to effect the backseal of the newly-formed, closed-end tube. The formed bag may be separated from the continuous material when the jaws are at their lowermost position.

Generally, no additional adhesive is required to seal the respective ends of a tube since the sheet material has a coating which forms an end seal when the jaws engage the tube firmly for a time sufficient to establish a seal. The back-seal generally requires adhesive primarily because the inside and outside surfaces of the sheet material are incompatible sealing surfaces due to variance in the chemistry of the surfaces. Further, the engaged edges are moved quickly past the back-sealer when the tube is pulled downward. The addition of adhesive in the high speed operation aids to assure the achievement of a sufficient seal. If the line of adhesive is defective in some way a defective back-seal may be formed which may allow product to spill out immediately which, although a loss, is a relatively minor problem. More often, the defect in the seal is so slight that it avoids detection and it may be air-tight for a time after the bag is filled and sealed, but lacks the strength to withstand the stresses encountered as the bag moves through the packaging distribution and sales chain.

The defectively sealed bag often goes undetected until the product moves into retail commerce. The customer may buy the package and be quite unaware that it has a defective seal. The faulty seal, however, may have caused the product to lose freshness and the customer is dissatisfied. Also, the customer may return the product to the store for exchange or a refund. Since by this time the whole chain of commercial transactions has occurred, the refund or exchange is generally accounted for by some type of back transactions giving credit to the retailer, route man and the like until reaching the product manufacturing stage. This is a costly and time-consuming process and the early identification of these apparently satisfactory, but actually defective, bags would provide a substantial saving to the product manufacturer and others involved in the commercial transaction.

SUMMARY OF THE INVENTION

By the present invention, the problems from the failure to have early identification of possibly defectively-sealed bags can be overcome. Thus an apparatus and method are provided which detect defects in the adhesive on the foregoing described bag-forming material which may result in a defective seal, and which prevent the filling of a bag formed with bag-forming material bearing defective adhesive.

In the invention, there is provided in the bag-forming and filling process described above a sensor to detect defects in the adhesive placed along one edge of the bag-forming material and to generate a first signal before the bag is filled with product which signal is indicative of the detection of an adhesive defect and its location on the bag-forming material. The signal serves to develop an output signal at a time corresponding to the time a closed-end tube bearing the detected defect is in a product-filling position. The output signal serves to prevent the filling of the closed-end tube. It is, therefore, an object of this invention to detect defects in the line of adhesive placed on the bag-forming material and to prevent bags formed from material bearing the defective line of adhesive from being filled with product.

DETAILED DESCRIPTION OF THE INVENTION

The invention can be described with reference to a preferred embodiment illustrated schematically in the drawing. There is shown a system for forming and sealing bags in a substantially continuous operation wherein a sealed bag extends below jaws 2, and a closed-end tube filled with product 14 extends above jaws 2. In operation, jaws 2 sever the lower product-filled and sealed bag, separate and move upward from their position in the drawing along the filled closed-end tube 4. The jaws stop their upward movement at a selected position below sealing heater 5 and close together thereby sealing the end of the filled tube extending below the jaws to form a filled bag. The jaws simultaneously seal an end of the next tube and move downward to draw additional sheet material over upstream tube-former 12 and move the engaged edges of the newly formed closed-end tube past the heater or back-sealer 5.

The downward movement of the jaws 2 advances bag-forming material 6 from roll 8 past sensor 10 and over former 12. A line of adhesive (not shown) is positioned along one edge of the bag-forming material within the detection area of sensor 10, and as the bag forming-material 6 bearing the line of adhesive moves past the sensor 10, the sensor detects any defect in the line of adhesive. The sensor as shown is a plurality of bag lengths positioned upstream from the product-filling position, for example about 5 to 15 lengths.

An optical sensor 10 is illustrated in the drawing and may be used to detect a variety of defects in the line of adhesive, such as, insufficient amounts of adhesive, breaks in the line of adhesive and improperly positioned adhesive. The optical sensor can be used with colored adhesive. Satisfactory results have been obtained with a Gould, model DL-TL10, color registration sensor but other commercially available devices may be employed.

Additional types of sensors which may be used in the present invention include magnetic sensors capable of detecting variations in the magnetic field of a magnetic material-containing adhesive radiation sensors capable of detecting variations in the radioactivity of a radioactive material-containing adhesive, as well as fluorescence sensors capable of detecting variations in the fluorescence of a fluorescent material-containing adhesive.

Upon detection of a defect in the adhesive or line of adhesive, the sensor 10 develops a corresponding first signal which is transmitted to a shift register 26 through a line 15 to input terminal 16. The shift register 26 receives a second input signal at input terminal 18 which indicates the advancement of a unit of the sheet material corresponding to the lengths of a bag over the tube-former 12 and into the product-filling position. To develop the second signal, a pivoted arm 19 is arranged to be activated by a cam (not shown) connected to the forming, sealing and filling machine in any suitable manner so as to complete a cycle of rotation each time a bag is formed and sheet material is advanced by the system. A magnet 20 is positioned on pivoted arm 19 to contact a magnetic switch 22 at the completion of each cycle of rotation. When contacted by the magnet 20, the magnetic switch 22 develops a second signal which is transmitted to the shift register 26 through a line 24 to the input terminal 18.

The shift register 26 counts the consecutive second signals received at the input terminal 18. After receiving a signal from the sensor 10, the shift register 26 counts a predetermined number of second signals. The number of second signals counted by the shift register, after receipt of an adhesive-defect signal from the sensor, is selected to correspond to the number of bag lengths between the sensor and the tube-filling position. When the predetermined number of second signals have been counted by the shift register 26, after it has received the defect signal from sensor 10, the shift register 26 develops an output signal which is transmitted through line 28 to product dumping or product weighing apparatus 30. This output signal disables apparatus 30, preventing the dumping and supply of product to the closed-end tube which is in the normal, product-filling position, but which bears the defective adhesive or line of adhesive. The product supplying apparatus 30 may be a weighing device or any mechanism for measuring or delivering quantities of product to a closed-end tube. Apparatus 30 receives product by way of conveyor 31.

The bag-forming and sealing operations continue otherwise unhindered so that the opposite end of the possibly defective, empty, closed-end tube is sealed and the empty bag formed thereby is moved down by the jaws 2 and the next portion of sheet material is advanced for forming, sealing and filling. The empty bag may be removed from the product line immediately after the bag is formed or at any convenient time.

The shift register 26 may be a commercially available device which is capable of developing an output signal after a predetermined time or amplifying and delaying the first signal until the sheet material bearing the defective adhesive or line or adhesive is in the filling position. Satisfactory results have been obtained with Gould, Series DL-LK, amplifiers although other devices may be used.

By detecting defects in the adhesive or line of adhesive before the bags are formed and by preventing the filling of bags or closed-end tubes bearing defective adhesive the present invention operates without interrupting the essentially continuous production of bags from bag-forming material. Since the empty possibly defectively-sealed bags are removed from the product line at a convenient time, the losses caused by defectively-sealed bags are eliminated by the invention, along with the associated customer dissatisfaction. The administrative expenses involved in processing and responding to customer complaints and providing refunds are also avoided.

With minor modifications this concept can be utilized to detect other defects in addition to defective adhesive application on the sheet material as supplied by the manufacturer of the sheet material to the packagers. Such defects could relate to improper application of coatings on the sheet material, tears in the material and like defects.

What is claimed is:

1. In a method for forming and filling bags of predetermined length from continuous, flexible, bag-forming sheet material, having a line of adhesive along its length, wherein the sheet material is formed into a tube, the tube is sealed at a position corresponding to the end of a bag, the closed-end tube is sealed along its length and filled with product, the filled portion of the tube is sealed and severed from the continuous sheet material at a position corresponding to the other end of the filled bag and said forming and filling are replicated, the steps for detecting and preventing the filling of possibly defectively-sealed bags, comprising passing the continuous sheet material to a tube-former for forming the sheet material into the tube, sensing said line of adhesive to detect defects therein and developing a signal indicative of such defect, said sensing being conducted upstream of said tube-former, and using said signal to prevent the filling of the tube when the portion of the sheet material bearing detected defective adhesive is in the bag-filling position.

2. In a method for forming and filling bags of predetermined length from continuous, flexible, bag-forming material, having a line of adhesive along its length, wherein the sheet material is formed into a tube, the tube is sealed at a position corresponding to the end of a bag, the closed-end tube is sealed along its length and filled with product supplied from a product weighing device, the filled portion of the tube is sealed and severed from the continuous sheet material at a position corresponding to the other end of the filled bag and said forming and filling are replicated, the steps for detecting and preventing the filling of possibly defectively-sealed bags, comprising passing the continuous sheet material to a tube-former for forming the sheet material into the tube, sensing said line of adhesive to detect defects therein, and developing a signal indicative of such defect, said sensing being conducted upstream of said tube former a distance corresponding to a plurality of lengths of the bags being formed, and said sensing serving to inactivate said product weighing device to prevent the filling of the closed-end tube when the portion of the sheet material having a detected defective adhesive condition is in the filling position.

3. An apparatus for use with a system for forming and filling bags from flexible sheet material bearing a line of adhesive along its length, comprising a sensor for detecting defects in said line of adhesive before said bag is formed and capable of developing a signal upon detection of said defect, and means for preventing the filling of a bag formed from sheet material bearing said defective adhesive upon receipt of said signal developed by said sensor.

4. An apparatus as recited in claim 3, wherein said sensor is an optical sensor capable of detecting variations in the color of adhesive to indicate a defect in said line of adhesive.

5. An apparatus for forming and filling bags of predetermined length from continuous, flexible, bag-forming sheet material, having a line of adhesive along its length comprising means for forming the sheet material into a tube, means for passing said sheet material to said forming means, means for sealing the tube at a position corresponding to the end of a bag, means for sealing the closed-end tube along its length, means for filling the formed bag with product, means for sealing the filled portion of the tube, means for severing the sealed bag from the continuous sheet material at a position corresponding to the other end of the filled bag, said bag forming and filling means being operable in a replicative manner, means for sensing said line of adhesive to detect defects therein and developing a signal indicative of such defect, said sensing means being positioned upstream of said tube-forming means, and means responsive to said signal to prevent the filling of the tube when the portion of the sheet material bearing detected defective adhesive is in the bag-filling position.

6. An apparatus for forming and filling bags of predetermined length from continuous, flexible, bag-forming material, having a line of adhesive along its length, comprising means for forming the sheet material into a tube, means for passing said sheet material to said forming means, means for sealing the tube at a position corresponding to the end of a bag, means for sealing the closed-end tube along its length, means for filling the formed bag with product including product weighing means, means for sealing the filled portion of the tube, means for severing the sealed bag from the continuous sheet material at a position corresponding to the other end of the filled bag, said forming and filling means being operable in a replicative manner, means for sensing said line of adhesive to detect defects therein and developing a signal indicative of such defect, said sensing means being positioned upstream of said tube-forming means a distance corresponding to a plurality of bag lengths along said sheet material, and said sensing means being capable of inactivating said product weighing means to prevent the filling of the closed-end tube when the portion of the sheet material having a detected defective adhesive condition is in the filling position.

7. An apparatus as recited in claim 3, wherein said sensor is a magnetic sensor capable of detecting variations in the magnetic field of a magnetic material-containing adhesive to indicate a defect in said line of adhesive.

8. An apparatus as recited in claim 3 wherein said sensor is a radiation sensor capable of detecting variations in the radioactive emissions of a radioactive material-containing adhesive to indicate a defect in said line of adhesive.

9. An apparatus as recited in claim 3 wherein said sensor is a fluorescence sensor capable of detecting variations in the fluorescence of a fluorescent material-containing adhesive to indicate a defect in said line of adhesive.

10. An apparatus as recited in claim 3 wherein said sensor is positioned a plurality of bag lengths from a bag filling position and said means is capable of delaying said signal until the length of sheet material bearing said defective line of adhesive is in the filling position and using said delayed signal to prevent the filling of a bag bearing said defective line of adhesive.

11. An apparatus as recited in claim 10 wherein said means is capable of counting each length of sheet material advanced to the filling position and delaying said signal until a sufficient number of bag lengths have been advanced to move the defect-bearing sheet material into the filling position.

12. An apparatus as recited in claim 10 wherein said signal is used to activate a second means for disabling a product dumping or product weighing device to prevent the filling of a bag bearing said defective line of adhesive.

13. An apparatus as recited in claim 11 wherein said signal is used to actuate a second means for disabling a product dumping or product weighing device to prevent the filling of bag bearing said defective line of adhesive.

* * * * *